United States Patent [19]

Salway

[11] 4,397,282

[45] Aug. 9, 1983

[54] FUEL INJECTION SYSTEMS FOR INTERNAL COMBUSTION ENGINES

[75] Inventor: Peter H. Salway, Birmingham, England

[73] Assignee: The Lucas Electrical Company Limited, Birmingham, United Kingdom

[21] Appl. No.: 888,979

[22] Filed: Mar. 22, 1978

Related U.S. Application Data

[63] Continuation of Ser. No. 624,601, Oct. 22, 1975.

[30] Foreign Application Priority Data

Oct. 25, 1974 [GB] United Kingdom ..... 46392/74

[51] Int. Cl.[3] ..... F02B 3/00

[52] U.S. Cl. ..... 123/487; 123/486

[58] Field of Search ..... 123/32 EB, 487

[56] References Cited

U.S. PATENT DOCUMENTS 3,835,819 9/1974 Anderson ..... 123/32 EB 3,904,856 9/1975 Monpetit .

*Primary Examiner*—Ronald B. Cox

*Attorney, Agent, or Firm*—Abelman, Frayne & Rezac

[57] ABSTRACT

A fuel injection timing system for a compression ignition engine makes use of a read only memory programmed to provide a digital output representing the time or shaft angle when injection is required in accordance with the values of digital input corresponding to speed and engine load. The speed data is obtained from a transducer which also provides position signals enabling an injection datum to be established so that a comparator can compare the output of the memory with a digital signal representing shaft angle or time to trigger injection at the required instant.

2 Claims, 3 Drawing Figures

FUEL INJECTION SYSTEMS FOR INTERNAL COMBUSTION ENGINES

This is a continuation of application Ser. No. 624,601 filed Oct. 22, 1975.

This invention relates to a timing system for an electrically actuated fuel injection system for an internal combustion engine, particularly a compression ignition engine.

The invention resides in a fuel injection timing system including a memory device which receives inputs representing engine speed and at least one further engine parameter and produces an output representing the crankshaft position at which fuel injection is to be initiated, this output being compared with a signal representing crankshaft position starting from a datum position, a common transducer being used to provide the required engine speed and crankshaft position signals.

In the accompanying drawings

Figures 1, 1A:
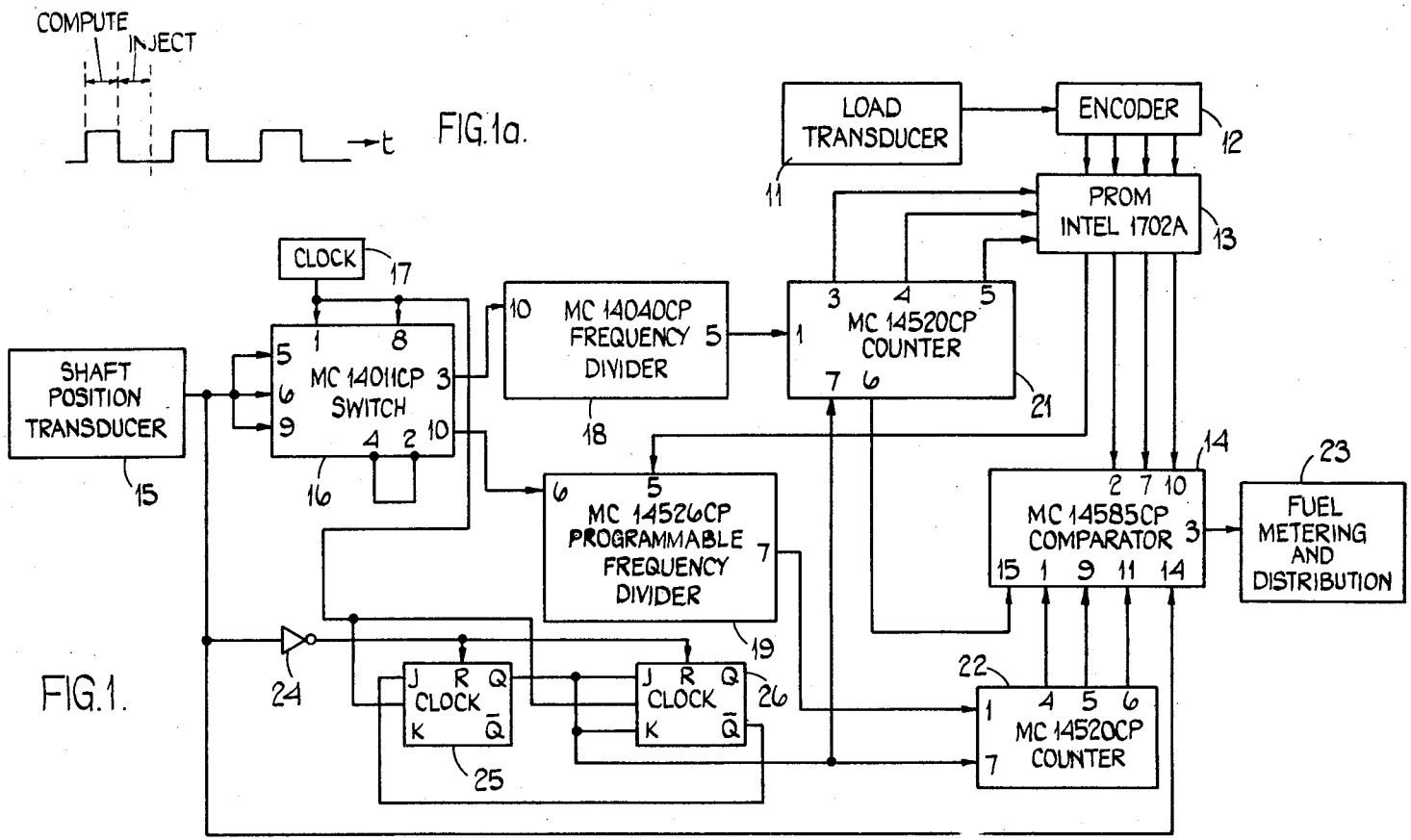

FIG. 1 is a block diagram illustrating one example of the invention,

FIG. 1*a* is a graph showing the timing of the example of FIG. 1 and

Figure 2:
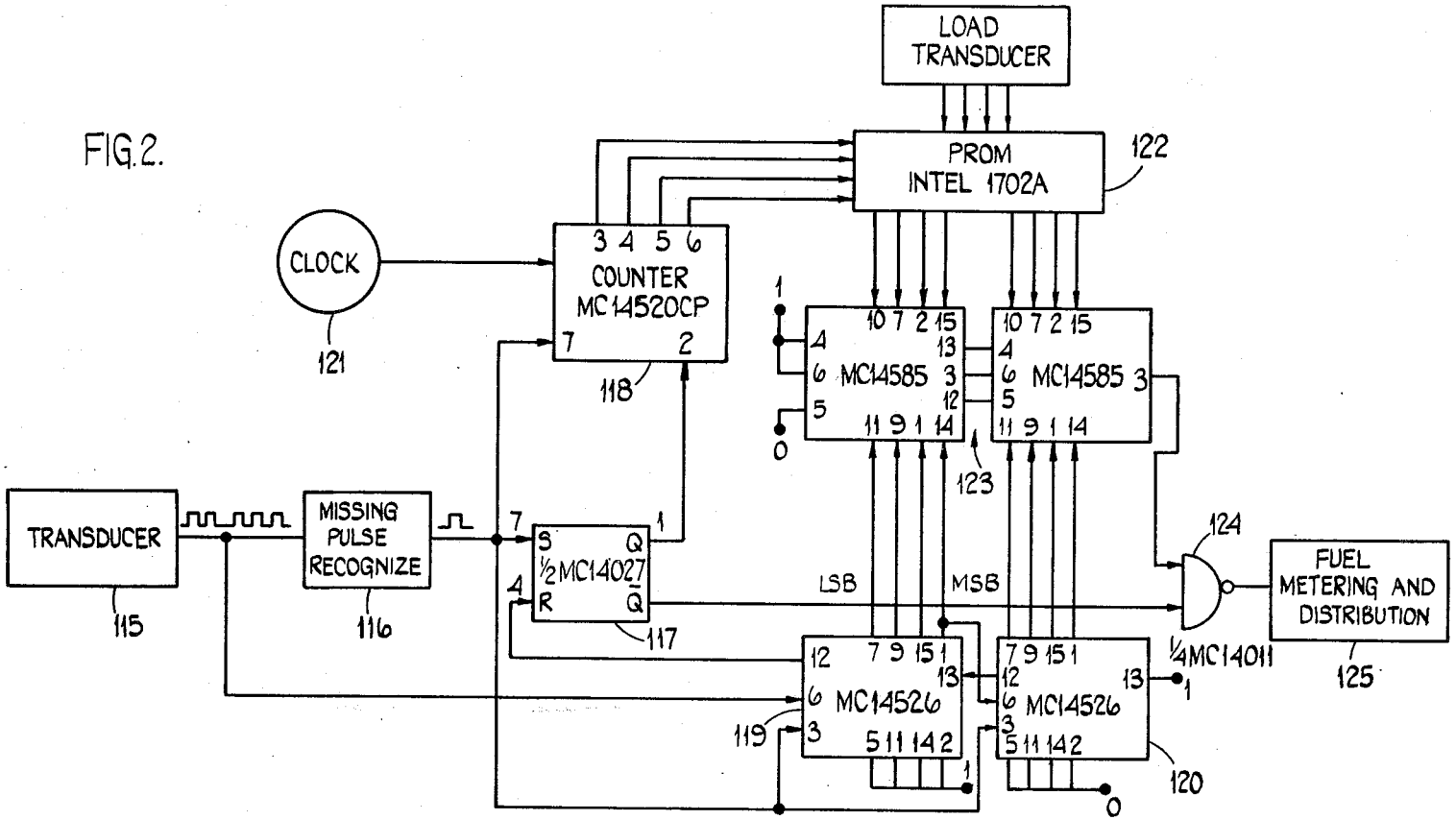

FIG. 2 is a block diagram of another example of the invention.

Referring to the drawing, an engine incorporates a transducer 11 producing an output representing engine load, this output being fed through a digital encoder 12 to a memory unit 13 which may be an Intel 1702A integrated circuit and which also receives an input representing the rotational speed of the engine. Alternatively, the transducer 11 could itself produce a digital output which is fed directly to the unit 13. The memory unit 13, which is of known form, is empirically programmed so that it produces an output dependent upon the two inputs it receives, and such output representing the instant at which fuel injection is to be initiated. The way in which the memory 13 is programmed is empirical, and depends upon the engine.

The output from the memory 13 is fed to a comparator 14 in the form of a C-MOS integrated circuit type MC14585CP which also receives a signal representing the position of the engine crankshaft. The prefix MC of the catalog numbers used to identify the circuits in the drawings, correspond to designation of the Motorola Corporation which manufactures these circuits. When the engine crankshaft is in the correct position, the comparator 14 produces an output to operate an electrical actuator which controls the fuel injection system.

Associated with the crankshaft 15*a* of the engine is a transducer 15 which produces an output voltage having two levels, conveniently referred to as 1 and 0 respectively. The arrangement is such that as each piston passes through the fully retarded fuel injection timing position, the output from the transducer 15 changes from 0 to 1. As each piston moves relative to its cylinder, then the output changes from 1 to 0 at a predetermined position, which typically is 30° of cam shaft rotation before the fully retarded position. Thus, as each piston moves on its compression stroke, the output from the transducer 15 changes from 1 to 0 well before the maximum required advance position, and then changes back to 0 at the fully retarded fuel injection timing position. The transducer 15 may be in the conventional form of a cam 15*b*, for example, rotating with the crank shaft 15*a*. The cam actuates a switch 15*c* which has two positions depending on the rotation of the cam. In an open position, the switch may be considered to provide a 0 signal, whereas in the closed position, the switch may be considered to provide a signal designated as 1. The transducer is thus a conventional device well known in the art.

The output from the transducer 15 is fed to an electronic two-way switch 16 in the form of a C-MOS integrated circuit type MC14011CP which consists of four NAND gates only three of which are used in the present case which also receives an input from a clock oscillator 17 operating at a predetermined frequency. The switch 16 provides an input to one of a pair of frequency dividers 18, 19, the arrangement being such that when the output from the transducer 15 is zero, the switch 16 is coupled to the divider 19, and when the output from the transducer 15 is 1, the switch 16 is coupled to the divider 18. The divider 18 which is in fact a C-MOS integrated circuit counter type MC14040CP connected as a divider provides an input to a counter 21 which is a C-MOS integrated circuit type MC14520CP, which in turn provides the required speed signal to the memory 13. It will be appreciated that whenever the output from the transducer 15 is 1, the fixed frequency oscillator 17 provides an input to the counter 21, which will therefore produce an output dependent upon engine speed. The divider 18 is set in accordance with the number of cylinders of the engine.

At the instant when a piston passes through the 30° position, the oscillator 17 will be coupled to the divider 19, (which is a C-MOS integrated circuit counter type MC14526CP connected as a programmable frequency divider) and disconnected from the divider 18. At that point in time, the output from the memory unit 13 will indicate to the comparator 14 the position of the piston at which fuel injection is to be initiated, measured from the 30° position. The oscillator 17 then counts into a counter 22 (via the divider 19), which provides an input to the comparator 14, and when the two inputs to the comparator 14 are equal, an output is produced to initiate fuel injection as previously explained. It will be appreciated that if, by way of example, 2° of advance are required, then the input to the comparator 14 from the memory will indicate that 28° of cam shaft angle are required before the output from comparator 14 is produced.

It will be appreciated that in the arrangement described above, since the oscillator 17 is coupled to the comparator 14 at the appropriate time, the comparator 14 compares time intervals, as represented by the pulses from the oscillator 17, with the signal it receives from the memory unit 13. The memory unit 13 must therefore be programmed appropriately, it being understood that at different speeds, the same output from the memory 13 could result in different advance characteristics, because the time intervals represented by the output from the oscillator 17 are fixed.

In most engine, there is a range of engine speeds, usually low engine speeds, at which full retarded injection timing is required. The counter 21 is arranged to produce a secondary output within such a speed range, this output being fed to the comparator 14 as shown in the drawing. When the comparator 14 receives this output from the counter 21, it produces an output to cause full injection to commence only at the full retarded position.

It will be appreciated that the counter 22 measures the position of the crankshaft with an accuracy determined by the frequency of the oscillator 17. However, the frequency of the oscillator 17 is limited by the capacity of the counter 22. The accuracy is improved, as shown in the drawing, by providing an input from the memory 13 to the frequency divider 2. The divisor of the divider 19 is then changed in accordance with the output of the memory 13. At high engine speeds, the counter 22 will be connected to the oscillator 17 for a relatively short period of time, and so the divisor is kept low. At low engine speeds, the counter 22 is connected to the oscillator 17 for a relatively long period of time, and so the memory 13 is programmed to increase the divisor for low engine speeds. Alternatively separate frequencies, not related to a single fundamental could be used.

For resetting the two counters 21, 22 at the commencement of each operating cycle a logical inverter 24 and two J-K type flip-flops 25 and 26 are employed (which may be a C-MOS integrated circuit type MC14027). The inverter 24 connects the output terminal of the transducer of the RESET terminals of the two flip-flops so that when the output of the transducer goes low the Q output of each flip-flop is set low substantially immediately (so that the $\overline{Q}$ outputs are high). The clock 17 is connected to the CLOCK terminals of both flip-flops, the Q output terminal of the flip-flop 25 is connected to the J and K terminals of the flip-flop 26 and also to the reset terminals of the counters 21, 22 and the $\overline{Q}$ output of the flip-flop 26 is connected to the J terminal of the flip-flop 25. The K terminal of flip-flop 25 is connected to a logical high. Thus when the transducer 17 output goes high both flip-flops are no longer held with their Q outputs low. Flip-flop 25 gives a high output at Q terminal for the next clock period only, resetting the counters 21, 22. The flip-flop 25, 26 then remain in a quiescent state (25 low, 26 high) until reset of the transducer going low. The two flip-flops act as one-shot circuit so that the next clock pulse received after the transducer's output goes high causes the Q output of flip-flop 25 to go high allowing the counters 21, 22 to count pulses received by them.

Although in the example described the oscillator 17 serves two functions, clearly two oscillators could be used for the two functions respectively. Also, the signal representing crankshaft position could be obtained from a device which produces an output dependent on crankshaft angle.

It will be appreciated that the timing control described above produces triggering pulses which initiate an electro/hydraulic injection system 23. Fuel injection will not commence immediately because of inherent delays in the system. The memory 13 is, however, programmed to take account of these delays. The system 23 usually operates by releasing a pre-metered dose of fuel for injection on receipt of the trigger pulse.

Turning now to FIG. 2 the transducer 115 used in this produces a large number of pluses in each revolution of the engine pulse, but the pulse train is interrupted by gaps, one for each injection. The transducer may be of the well known type including a gear wheel which is rotated relative to a magnetic pick up, the gaps in the pulse train being obtained by the removal of appropriate ones of the teeth of the gear wheel. In this case the transducer would preferably include a pulse squaring circuit.

The transducer 115 is connected to a missing pulse recognition circuit 116 which produces a positive going marker pulse whenever a gap in the pulse train from the transducer 115 is detected. The circuit 116 and a flip-flop circuit 117 are used to control the sequence of the system, the output terminal of the circuit 116 being connected to the SET terminal of the flip-flop (which is one half of a C-MOS integrated circuit dual flip-flop type MC14027). The output of the circuit 116 is also connected to the RESET terminal of a counter 118 (a C-MOS integrated circuit counter type MC14520) and to the PRESET ENABLE terminal of two programmable counters 119, 120 (C-MOS integrated circuits type MC14526). The former counter 118 acts as a speed measuring counter and, for this purpose, has its CLOCK input terminal connected to a clock oscillator 121 and its ENABLE terminal connected to the Q output terminal of the flip-flop circuit 117. The data outputs of counter 118 are connected to one set of data inputs of an integrated circuit memory device 122, which, as in the first example, has a load transducer providing a digital signal to its other set of data inputs. The output of the memory 122 is applied to a comparator 123 consisting of two cascaded C-MOS integrated circuit comparators type MC14585 which compare the input from the memory 122 with the output of the counters 119, 120.

The two counters 119, 120 are connected in cascade, that is the CLOCK input of the counter 119 receives pulses from the transducer 115 whereas the CLOCK input of the counter 120 receives its pulses from the MSB data output terminal of the counter 119. The CASCADE FEEDBACK terminal of the counter 120 is held high and the same terminal of the counter 119 is connected to the CARRY terminal of the counter 120. The CARRY terminal of the counter 119 is connected to the RESET terminal of the flip-flop 117. The data inputs of the counter 119 are all held high (so that it presets to 1111) and those of the counter 120 are held low (so that it presets to 0000).

The $\overline{Q}$ output of the flip-flop 117 and the output of the comparator 123 are connected to the input terminals of a NAND gate 124 which provides the required trigger output to the fuel metering and distribution system 125 (which corresponds to the system 23 of FIG. 1).

In operation each pulse from the circuit 116 resets the counter 118 to 0000, and sets the counters 119 and 120 to 111 and 0000 respectively. In addition the flip-flop 117 is set and its output enables the counter 118 but inhibits the gate 124. Pulses from the clock oscillator 121 are now counted into the counter 118 and pulses from the transducer 115 are counted into the counter 119 to cause the latter to count down. This continues until counter 119 achieves the count state 0000 when a carry pulse appears at the CARRY output of counter 119 and this resets the flipflop 117 thereby stopping the count being made by counter 118. It will be appreciated that it takes just fifteen pulses from the transducer 115 for this to occur and such fifteen pulses represent a fixed angle of rotation of the engine shaft. The next pulse from the transducer 115 causes the counter 119 to be set to 1111 and this change also causes counter 120 to be set to 1111. Count down now continues until the count from the counters 119, 120 is equal to the output of the memory device 122 which in turn depends on the state of counter 118 and the signal from the transducer. The output of the comparator then goes high and the gate 124 produces the low signal that is the trigger pulse for the system 125. The counters 119 120 will continue to count down until the next pulse appears from the circuit 116 but the count of the counter 120 will be too low for the comparator output to go low again before this occurs.

It will be appreciated that the example shown in FIG. 2 differs from that shown in FIG. 1 principally in that, in FIG. 2, the memory device 122 is required output to an angle signal as distinct from a time signal in FIG. 1.

I claim:

1. Apparatus for controlling the timing of commencement of injection of fuel in a diesel engine comprising the combination of (a) an empirically programmed read only memory for producing an multi-bit digital output signal in accordance with values of two independently variable multi-bit digital input signal for application to the read only memory;

(b) engine load sensitive means generating one multi-bit digital signal for application to the read only memory;

(c) engine crankshaft position transducer means mechanically connected to the engine and producing a train of marker pulses occurring at specific angular positions of the crankshaft, at least one of said marker pulses occurring at a datum position of said crankshaft;

(d) a fixed frequency oscillator;

(e) a first counter;

(f) first pulse routing means controlled by said transducer means for routing pulses from said oscillator to said first counter for a first period between two of said marker pulses, so that said first counter accumulates a count representing engine speed;

(g) said first counter being connected to the read only memory so as to apply thereto the other of said two multi-bit digital input signals;

(h) a second counter;

(i) second pulse routing means controlled by said transducer means for routing pulses from said oscillator to said second counter for a subsequent period commencing when said at least one marker pulse occurs, so that said second counter accumulates a count representing the time elapsed since said at least one marker pulse occurred;

(j) comparator means connected to the memory and the second counter and producing an output signal when the multi-bit digital output signal of the read only memory, and the count in the second counter are equal; and (k) fuel injection control means connected to said comparator means and operating to commence injection when the comparator means produces an output signal;

(l) the read-only memory being empirically programmed to provide a desired relationship between the time elapsing between the datum marker pulse produced by the transducer means, and the comparator producing its output signal, the engine speed, and the value of the engine load, with the said first and second routing means including a common switch circuit controlled by the transducer means and the oscillator and arranged to direct the oscillator pulses either to the first counter or to the second counter in accordance with the output of the transducer means.

2. Apparatus for controlling the timing of commencement of injection of fuel in a diesel engine comprising the combination of (a) an empirically programmed read only memory for producing a multi-bit digital output signal in accordance with values of two independently variable multi-bit digital input signals applied thereto;

(b) engine load sensitive means generating one multi-bit digital signal for application to the read only memory;

(c) engine crankshaft position transducer means mechanically connected to the engine and producing a train of marker pulses occurring it specific angular positions of the crankshaft, at least one of said marker pulses occurring at a datum position of said crankshaft;

(d) a fixed frequency oscillator;

(e) a first counter;

(f) first pulse routing means controlled by said transducer means for routing pulses from said oscillator to said first counter for a first period between two of said marker pulses, so that said first counter accumulates a count representing engine speed;

(g) said first counter being connected to the read only memory so as to apply thereto the other of said two multi-bit digital input signals, (h) a second counter;

(i) second pulse routing means controlled by said transducer means for routing pulses from said oscillator to said second counter for a subsequent period commencing when said at least one marker pulse occurs, so that said second counter accumulates a count representing the time elapsed since said at least one marker pulse occurred, with said second pulse routing means including a programmable frequency divider having a control input connected to an auxiliary output of the memory device;

(j) comparator means connected to the memory and the second counter and producing an output signal when the multi-bit digital output signal of the read-only memory, and the count in the second counter are equal; and (k) fuel injection control means connected to said comparator means and operating to commence injection when the comparator means produces an output signal; p1 (l) the read-only memory being empirically programmed to provide a desired relationship between the time elapsing between the datum marker pulse produced by the transducer means, and the comparator producing its output signal, the engine speed, and the value of the engine load.

* * * * *